US006105319A

United States Patent [19]

Brunt

[11] Patent Number: 6,105,319

[45] Date of Patent: Aug. 22, 2000

[54] MULTIPLE GLAZING UNITS

[75] Inventor: William Henry Brunt, Manchester, United Kingdom

[73] Assignee: Pilkington United Kingdom Limited, Merseyside, United Kingdom

[21] Appl. No.: 09/011,261

[22] PCT Filed: Aug. 13, 1996

[86] PCT No.: PCT/GB96/01977

§ 371 Date: Jul. 7, 1998

§ 102(e) Date: Jul. 7, 1998

[87] PCT Pub. No.: WO97/08416

PCT Pub. Date: Mar. 6, 1997

[30] Foreign Application Priority Data

Aug. 30, 1995 [GB] United Kingdom ..... 9517639

[51] Int. Cl.[7] ..... E06B 7/00

[52] U.S. Cl. ..... 52/204.593; 52/235; 52/741.4; 52/786.13

[58] Field of Search ..... 52/204.593, 204.63, 52/208, 235, 741.4, 745.13, 747.1, 786.1, 786.13, 788.1

[56] References Cited

U.S. PATENT DOCUMENTS

| | | | |
|---|---|---|---|
| 3,434,903 | 3/1969 | Hann | 52/208 X |
| 4,139,971 | 2/1979 | Kimura | 52/208 |
| 4,581,868 | 4/1986 | McCann | 52/204.593 |
| 4,587,784 | 5/1986 | Chavy et al. | 52/788.1 X |
| 4,680,206 | 7/1987 | Yoxon et al. | 52/786.1 X |
| 4,893,443 | 1/1990 | Haber . | |
| 4,987,699 | 1/1991 | Gold | 52/208 X |
| 5,027,567 | 7/1991 | Roberts | 52/204.593 X |
| 5,540,514 | 7/1996 | Demars et al. | 52/235 X |
| 5,558,387 | 9/1996 | Sumida et al. | 52/208 X |

FOREIGN PATENT DOCUMENTS

| | | |
|---|---|---|
| 0 192 472 | 8/1986 | European Pat. Off. . |
| 506522 | 9/1992 | European Pat. Off. . |
| 552101 | 7/1993 | European Pat. Off. . |
| 0 608 063 | 7/1994 | European Pat. Off. . |
| 34 42 911 | 6/1986 | Germany . |
| 41 01 277 | 7/1992 | Germany . |
| 2 148 372 | 5/1985 | United Kingdom . |
| 2 162 228 | 1/1986 | United Kingdom . |
| 2 171 137 | 8/1986 | United Kingdom . |
| 2 178 471 | 2/1987 | United Kingdom . |

*Primary Examiner*—Carl D. Friedman
*Assistant Examiner*—Kevin D. Wilkens
*Attorney, Agent, or Firm*—Burns, Doane, Swecker & Mathis, L.L.P.

[57] ABSTRACT

A multiple glazing unit has first and second panes held apart by a spacer frame. The unit is suspended from a structure, such as a building framework, by a supporting assembly which extends through apertures in the first and second panes respectively. The supporting assembly includes a boss which is located between the first and second panes. Annuli of adhesive tape are used to seal the boss and the first and second panes respectively.

16 Claims, 4 Drawing Sheets

MULTIPLE GLAZING UNITS

DESCRIPTION

1. Technical Field

The invention relates generally to multiple glazing units of the kind having an outer pane and an inner pane held apart by a spacer frame bounding a sealed space, and in particular to units which are suspended from structures by supporting assemblies extending through respective apertures in at least one of the panes, usually within the spacer frame. Such units are commonly used to glaze the walls or roofs of buildings, where large uninterrupted glass surfaces are specified.

2. Background Art

EP 0192472 discloses sealed multiple glazing units, available from the applicant in the UK and elsewhere under the trade mark PLANAR, which are each provided with a number of supporting assemblies, for example four on a 2m×1m rectangular unit, for suspending the unit from a support structure, such as a building framework of aluminium mullions. Each assembly is clamped to one of the inner or outer panes, within the spacer frame, enabling an array of units to be suspended in an edge-to-edge fashion so as to present a continuous exterior surface.

Various different embodiments are shown and described in EP 0192472, but in a preferred configuration the supporting assembly includes a bolt, a boss between the two panes and a clamping nut by which the bolt is fastened to the outer pane. The bolt extends through an aperture in the outer pane, through the boss, through an aperture in the inner pane and protrudes beyond the clamping nut. The protruding bolt may be secured to a bracket, commonly known as a spring plate, or to a rod, attached to the support structure. A flushfronted exterior appearance is maintained by countersinking the bolt head in the outer pane.

The boss, which holds the two panes spaced apart, is generally cylindrical and of a diameter greater than that of the aperture in the inner pane. Consequently, the boss has to be fitted between the panes before they are put together on completion of the unit. The boss is sealed to each of the panes using silicone sealant, applied by the unit assembler by hand after putting the panes together. Subsequently, the unit has to be put on one side in a specialist storage area for in the region of twenty four hours to ensure that the silicone has properly cured. Finally, the boss is inspected by the assembler, and any excess silicone is removed, again, by hand, using an appropriate tool.

The step of sealing the boss is therefore extremely time consuming, contributing a substantial proportion of the overall production time of a unit, in addition to being labour intensive.

The Invention

The invention provides a multiple glazing unit having an outer pane and an inner pane held apart by a spacer frame, a supporting assembly for suspending the unit from a structure, the supporting assembly extending through an aperture in one of the panes, wherein the supporting assembly comprises a boss located between the two panes, and sealing material between the boss and the apertured pane, characterised in that the sealing material is adhesive tape.

Adhesive tape provides a seal of comparable quality to silicone whilst being much quicker and less labour intensive to apply, and requires no curing.

Preferably, the supporting assembly extends through an aperture in the other of the panes and there is further sealing material between the boss and the other pane, characterised in that the further sealing material is adhesive tape.

The aperture may be within the spacer frame.

The adhesive tape is preferably self-adhesive and double-sided, that is, adhesive on each of its opposite sides, although the tape may be adhesive not simply on its sides but throughout. The adhesive tape may be translucent and of plastics material, such as acrylic. Suitable acrylic tapes are available in the UK from the 3M company under the trade mark VBH.

The boss may be generally cylindrical, and have a main body portion which is either solid or at least partially hollow. In the latter case, the body portion preferably comprises end flanges separated by a plurality of webs, for instance four, five, seven or nine, most preferably seven. The boss may also be translucent and of plastics material, such as Nylatron 66 or aramide. The combination of translucent adhesive tape and a translucent boss improves the appearance of a unit according to the invention in comparison to prior art units.

Most commonly, the two panes are toughened glass, with the outer pane 10 or 12 mm thick and the inner pane 6 mm thick. Alternatively, the inner pane may be 10 or 14 mm thick laminated glass. Pane thicknesses can, however, be varied according to requirements and the applicants also often make and supply units with for example, 15 or 19 mm thick toughened outer panes. Also, the aperture size may vary according to glass type.

The invention also provides a method of making a multiple glazing unit having first and second panes held apart by a spacer frame, a supporting assembly for suspending the unit from a structure, the supporting assembly extending through an aperture in one of the panes, wherein the supporting assembly comprises a boss located between the two panes, and sealing material between the boss and the aperture pane, characterised by using adhesive tape as the sealing material.

THE DRAWINGS

BEST MODE

Figure 1:
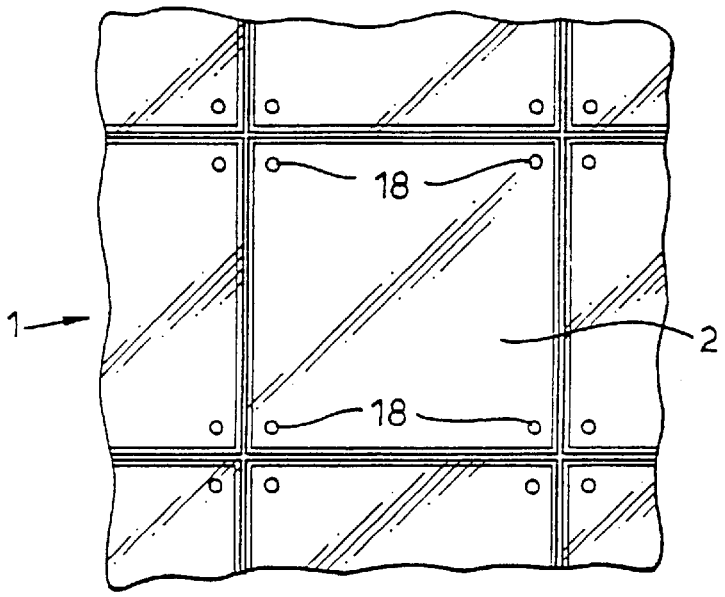
FIG. 1 is an elevation of part of the outside of a glass wall constructed using multiple glazing units according to an embodiment of the invention.

With reference to FIG. 1, an array of sealed multiple glazing units 2 are suspended in an edge-to-edge fashion from a framework of aluminium mullions behind the units 2 (not shown), to form a glass wall, indicated generally at 1, with a continuous exterior surface.

Figure 2:
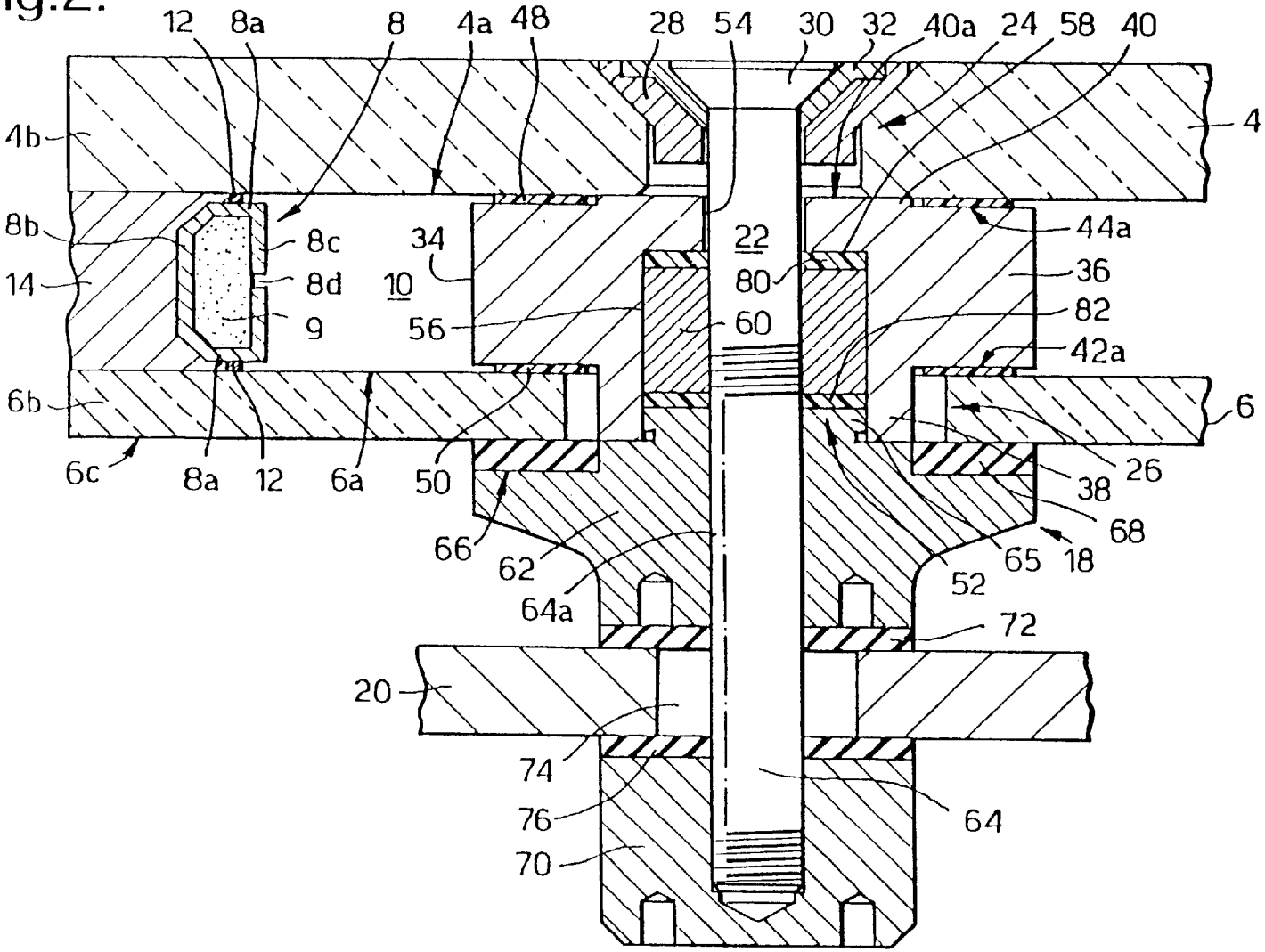
FIG. 2 is a partial sectional view showing the part of one of the units from the wall illustrated in FIG. 1, including the supporting assembly.

With reference also to FIG. 2, a sealed multiple glazing unit 2 has a first, toughened glass outer pane 4, 10 mm thick, and a second, toughened glass inner pane 6, 6 mm thick. The two panes 4,6 are held spaced 16 mm apart by a spacer frame constructed from a length of spacer bar 8, containing desiccant 9, which is bent to match the outline shape of the unit 2. The space 10 between the panes 4,6, bounded by the spacer frame, is sealed against moisture ingress by beads of primary butyl sealant 12 (exaggerated in FIG. 2) between each sealing edge 8*a* of the spacer bar 8 and the adjacent face 4*a*, 6*a* of the respective pane 4,6, and a mass of secondary silicone sealant 14 between the margins 4*b*, 6*b* of the panes 4,6, to the exterior side 8*b* of the spacer bar 8. Any moisture which is initially trapped within the sealed space 10, on construction of the unit 2, is absorbed by the desiccant 9, through holes 8*d* in the side 8*c* of the spacer bar 8 facing the sealed space 10.

Each unit 2 is suspended from the aluminium mullions by four supporting assemblies 18, one at each corner of the unit 2. The supporting assemblies 18 are positioned within the perimeter defined by the spacer frame, pass right through the sealed space 10, and are secured to respective spring plates 20, each attached to an appropriate mullion.

Each supporting assembly 18 comprises a bolt 22 which extends through a countersunk aperture 24, 19 mm diameter, in the outer pane 4, through the sealed space 10 and through an aperture 26, 34 mm diameter, in the inner pane 6. Fitted into the countersunk aperture 24 is a correspondingly shaped, translucent nylon-type material (known in the UK as TR55) bush 28. The countersunk head 30 of the bolt 22 engages a stainless steel cup washer 32 which sits in the bush 28.

Figure 3:
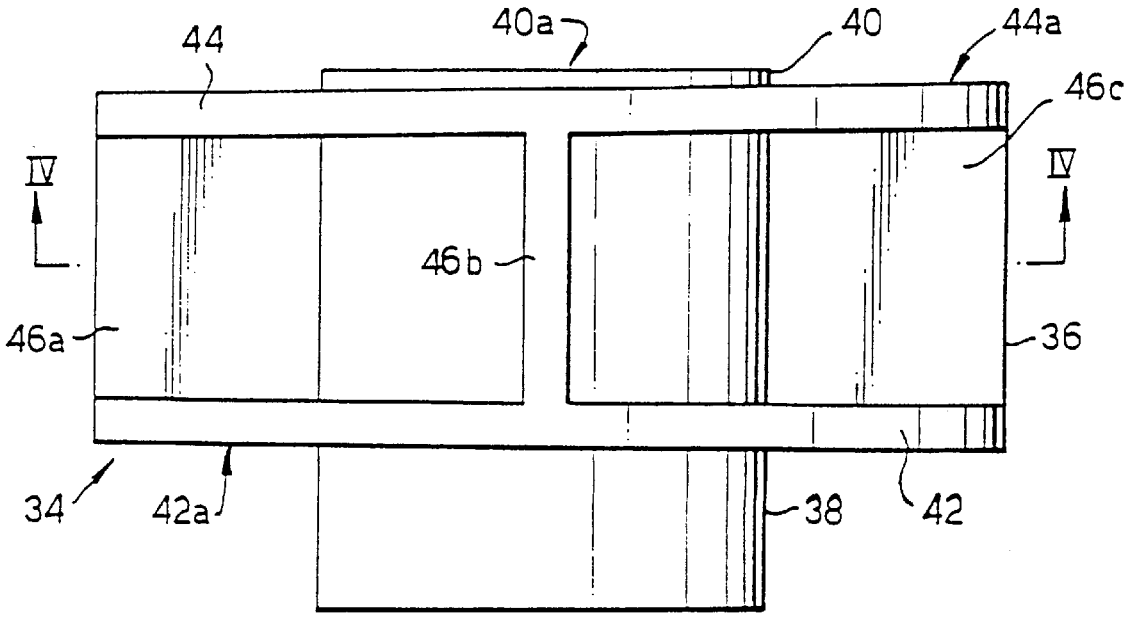
FIG. 3 is a complete side view of a boss shown only in section in FIG. 2.
Figure 4:
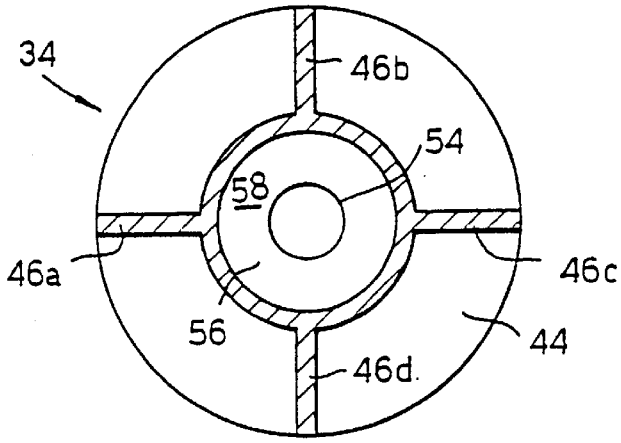
FIG. 4 is an end section of the boss shown in FIG. 3, taken along the line IV—IV.

With reference also to FIGS. 3 and 4, each supporting assembly 18 also comprises a translucent aramide boss 34 which is located in the sealed space 10. The boss 34 is generally cylindrical and its main, middle, body portion 36 is of greater diameter than the aperture 26 in the inner pane 6, although the boss 34 has reduced diameter portions 38,40 at either end. The first reduced diameter portion 38 at the end nearest the inner pane 6 protrudes into the inner pane aperture 26, but is of considerably smaller diameter than that aperture 26 so as to provide a clearance between the pane 6 and the boss 34. This clearance allows the unit to flex, as described in EP 0192472. The second reduced diameter portion 40 at the end nearest the outer pane 4 has its major, exposed surface 40*a* against the innermost surface 4*a* of the outer pane 4, around the edge of the outer pane aperture 24. The boss 34 is predominantly hollow between the end annular flanges 42, 44 respectively of the main body portion 36. The flanges 42, 44 are separated by four radially extending webs 46*a–d* which are equiangularly spaced. The end annular surfaces 42*a*, 44*a* of the flanges 42, 44 respectively serve as sealing surfaces, the first being the surface 42*a* next to the inner pane 6 and the second being the surface 44*a* next to the outer pane 4.

Figure 5:
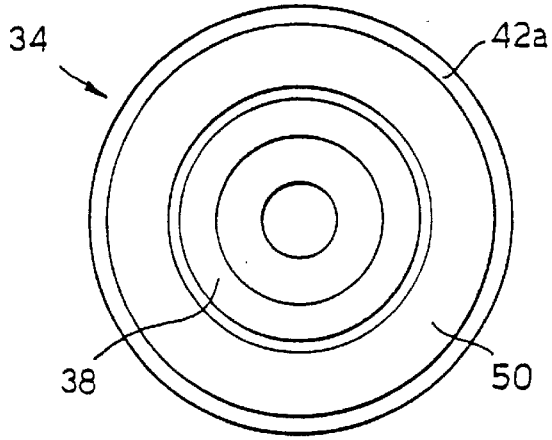
FIGS. 5 and 6 are opposite end views of a boss to which sealing material, in the form of annuli of double-sided tape, has been stuck, for use in the wall illustrated in FIG. 1.
Figure 6:
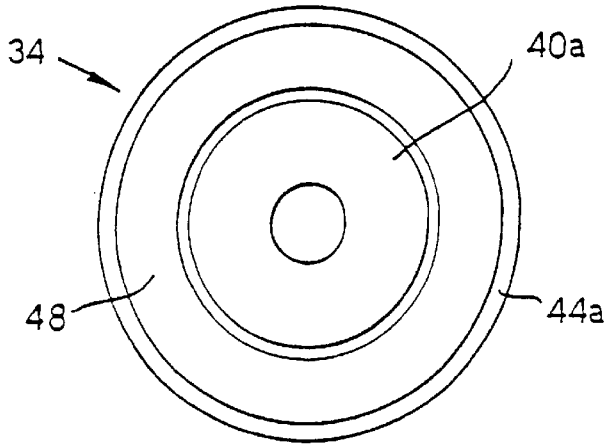
Figure 7:
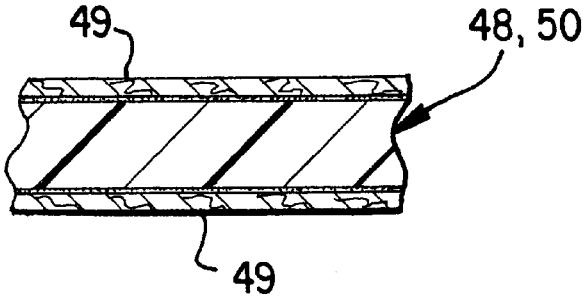
FIG. 7 is a cross-sectional view of the self-adhesive tape that can be used in the present invention, with backing paper attached to both sides.

The boss 34 holds the panes 4,6 spaced apart at the apertures 24, 26. Moisture ingress into the sealed space 10 through the apertures 24, 26 is prevented by sealing material 48, 50 between the boss 36 and the adjacent faces 4*a*, 6*a* of the panes 4, 6. The sealing material 48, 50 comprises annuli of translucent double sided acrylic self-adhesive tape, of the type available in the UK from the 3M company under the trade mark VBH (see also FIGS. 5 and 6). FIG. 7 illustrates the tape 48, 50 with a backing paper 49 applied to opposite sides of the tape. A first annulus of tape 50, 2 mm thick, has one side adhered to the first boss sealing surface 42*a* and the other side adhered to the innermost surface 6*a* of the inner pane 6. A second annulus of tape 48, 1 mm thick, has one side adhered to the second boss sealing surface 44*a* and the other side adhered to the innermost surface 4*a* of the outer pane 4. The tape 48, 50 is resilient so as to allow the panes 4,6 to flex in relation to the boss 34, for example, under wind loading or as a result of temperature fluctuations etc.

The boss 34 has a central hole 52 through which the bolt 22 extends. The hole is stepped: At the end closest to the outer pane 4, the hole 52 is of a diameter only slightly greater than that of the bolt 22 whereas at the end closest to the inner pane 6, the diameter is much greater. These two different diameter portions 54, 56 are divided by a step 58 about one fifth along the hole 52 from the end closest the outer pane 4. Optionally, a stainless steel insert sleeve 60 is slotted into the wide diameter hole portion 56, on top of a silicone cushion washer 80, so as to fill the annular space between the boss 34 and the shaft 64 of the bolt 22, and a silicone cushion washer 82 is inserted into the hole portion 56 over the insert sleeve 60.

A clamping nut 62 is screwed on to the threaded part 64*a* of the bolt shaft 64. The nut 62 has a reduced diameter inner portion 65 which extends into the boss hole 52 and abuts against the cushion washer 82. Tightening the nut 62 has the effect of urging the boss 34, as a result of action on the first reduced diameter portion 38, towards the outer pane 4, clamping the outer pane 4 between the bolt head 30 and the boss 34, thereby making the bolt 22 fast with the outer pane 4. The clamping nut 62 is cut away around its periphery and in the cutaway 66 is seated a translucent silicone washer 68 which is compressed against the outer surface 6*c* of the inner pane 6 when the nut 62 is tightened.

A self-locking fixing nut 70 is used to secure the protruding bolt shaft 64 to the spring plate 20. A rubber washer 72 is pushed on to the bolt 22 against the clamping nut 62 and the protruding shaft 64 of the bolt 22 is passed through a wide, 18 mm diameter, hole 74 in the spring plate 20. A further rubber washer 76 is then placed over the bolt 22 and the nut 70 is tightened on to the bolt shaft 64.

Figure 8:
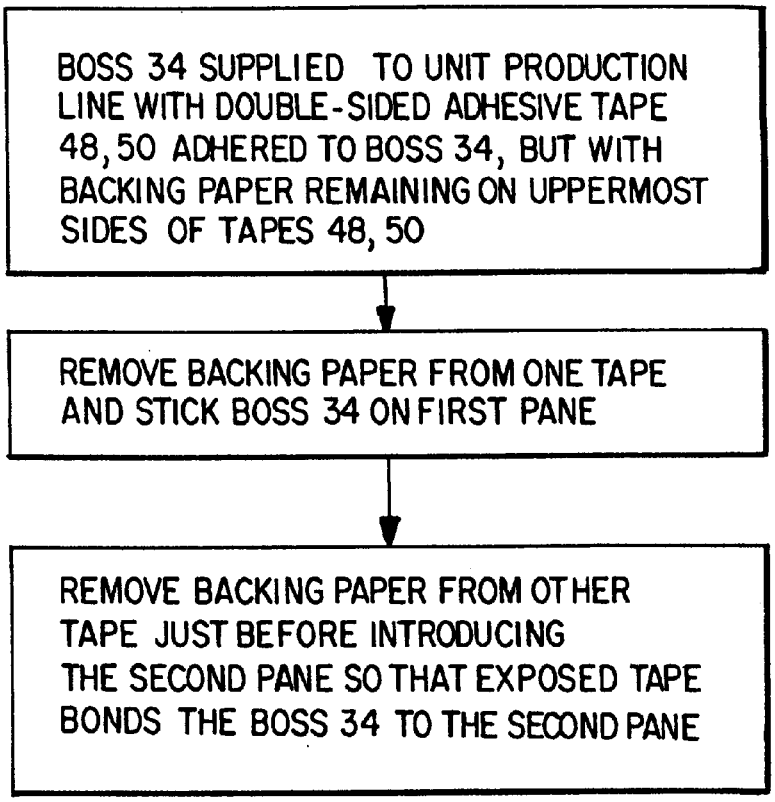
FIG. 8 is a flow chart illustrating a manner of installing the boss between two glass panels.

The boss 34 has to be installed between the panes 4, 6 before they are put together on completion of the unit 2. As shown by way of the flowchart in FIG. 8, the bosses 34 are supplied to the unit production line with the double-sided adhesive tape 48, 50 adhered to them but with the backing paper left on the uppermost sides. The unit assembler firstly removes the backing paper from the adhesive tape 48 and sticks the boss 34 on to the outer pane 4. Later in the production cycle, the assembler removes the backing paper from the tape 50 just before introducing the inner pane 6, and the exposed tape bonds the boss 34 to the inner pane 6. Not removing the backing paper until the last possible moment minimises the risk of contamination, with dirt, grease etc, to the tape's adhesive surfaces. Next, the two panes 4,6 are pressed together so as to ensure that the unit 2 is fully sealed. Lastly, secondary silicone sealant 14 is applied around the edge of the unit 2.

What is claimed is:

1. A multiple glazing unit comprising first and second panes held apart by a spacer frame, a supporting assembly for suspending the unit from a structure, the supporting assembly extending through an aperture in one of the panes, wherein the supporting assembly comprises a boss located between the two panes, and sealing material between the boss and the apertured pane, the sealing material being adhesive tape.

2. A multiple glazing unit according to claim 1 wherein the one pane is the first pane, the supporting assembly extending through an aperture in the second pane, and having further sealing material between the boss and the second pane, the further sealing material being adhesive tape.

3. A multiple glazing unit according to claim 1 wherein the aperture has an axis located within a perimeter defined by the spacer frame.

4. A multiple glazing unit according to claim 1 wherein the adhesive tape is self-adhesive.

5. A multiple glazing unit according to claim 1 wherein the adhesive tape is translucent.

6. A multiple glazing unit according to claim 1 wherein the adhesive tape is double-sided.

7. A multiple glazing unit according to claim 6 wherein the adhesive tape is adhesive throughout.

8. A multiple glazing unit according to claim 1 wherein the adhesive tape is of plastics material.

9. A multiple glazing unit according to claim 8 wherein the adhesive tape is acrylic.

10. A multiple glazing unit according to claim 1 wherein the boss is generally cylindrical, and has a main body portion which is at least partially hollow.

11. A multiple glazing unit according to claim 10 wherein the main body portion is at least partially hollow and comprises end flanges separated by a plurality of webs.

12. A multiple glazing unit according to claim 1 wherein the boss is translucent.

13. A multiple glazing unit according to claim 12 wherein the boss is of plastics material.

14. A method of making a multiple glazing unit that includes a supporting assembly for suspending the unit from a structure and first and second panes, the supporting assembly including a boss, the method comprising positioning the supporting assembly so that the supporting assembly extends through an aperture in one of the panes, with the boss being located between the first and second panes and so that sealing material in a form of adhesive tape is located between the boss and the one pane.

15. A method according to claim 14 including adhering the adhesive tape to the boss before positioning the supporting assembly so that the boss is located between the first and second panes.

16. A method according to claim 15 including uncovering an uppermost side of the adhesive tape just before positioning the supporting assembly so that the boss is located between the first and second panes.

* * * * *